US009084906B2

(12) United States Patent
Schurian et al.

(10) Patent No.: US 9,084,906 B2
(45) Date of Patent: Jul. 21, 2015

(54) HARNESS WEBBING ELEVATION SYSTEM

(75) Inventors: Cortland G. Schurian, Long Beach, CA (US); Davies Evan, West Hollywood, CA (US)

(73) Assignee: Alexander Andrew, Inc., Compton, CA (US)

( * ) Notice: Subject to any disclaimer, the term of this patent is extended or adjusted under 35 U.S.C. 154(b) by 111 days.

(21) Appl. No.: 13/252,155

(22) Filed: Oct. 3, 2011

(65) Prior Publication Data

US 2013/0008742 A1 Jan. 10, 2013

Related U.S. Application Data

(60) Provisional application No. 61/389,212, filed on Oct. 2, 2010.

(51) Int. Cl.
*A62B 35/00* (2006.01)

(52) U.S. Cl.
CPC ..... *A62B 35/0031* (2013.01); *A62B 35/0025* (2013.01); *A62B 35/0037* (2013.01)

(58) Field of Classification Search
CPC ..... A62B 35/0006; A62B 35/0012; A62B 35/0018; A62B 35/0025; A62B 35/0031; A62B 35/0037; A47D 13/086; A01K 27/005
USPC ..... 182/3, 4, 6, 7; 119/770; 2/309, 310, 311
See application file for complete search history.

(56) References Cited

U.S. PATENT DOCUMENTS

| | | | | | |
|---|---|---|---|---|---|
| 2,574,178 | A | * | 11/1951 | Haller | 182/3 |
| 3,424,134 | A | * | 1/1969 | Rosenblum | 182/3 |
| 4,747,527 | A | * | 5/1988 | Trumpower, II | 224/662 |
| 5,148,549 | A | * | 9/1992 | Sydor | 2/44 |
| 5,176,131 | A | * | 1/1993 | Votel et al. | 602/19 |
| 5,388,274 | A | * | 2/1995 | Glover et al. | 2/338 |
| 5,432,951 | A | * | 7/1995 | Yewer, Jr. | 2/44 |
| 5,464,136 | A | * | 11/1995 | Eddy | 224/666 |
| 5,503,620 | A | * | 4/1996 | Danzger | 602/19 |
| 5,531,292 | A | * | 7/1996 | Bell | 182/3 |
| 5,548,843 | A | * | 8/1996 | Chase et al. | 2/102 |
| 5,560,046 | A | * | 10/1996 | Iwamasa et al. | 2/328 |
| 5,586,969 | A | * | 12/1996 | Yewer, Jr. | 602/19 |
| 5,728,055 | A | * | 3/1998 | Sebastian | 602/19 |
| 5,797,143 | A | * | 8/1998 | Buxton | 2/102 |
| 6,101,631 | A | * | 8/2000 | Ferguson, Jr. | 2/94 |
| 6,125,475 | A | * | 10/2000 | Taylor | 2/333 |
| D454,986 | S | * | 3/2002 | Casebolt et al. | D29/101.1 |
| 6,658,666 | B2 | * | 12/2003 | Schweer | 2/94 |
| 6,766,532 | B1 | * | 7/2004 | Cabana | 2/44 |
| 6,971,476 | B2 | * | 12/2005 | Wolner et al. | 182/3 |
| 7,086,091 | B2 | * | 8/2006 | Jordan | 2/69 |
| 7,779,789 | B2 | * | 8/2010 | Tanaya | 119/770 |

* cited by examiner

*Primary Examiner* — Alvin Chin-Shue
*Assistant Examiner* — Colleen M Chavchavadze

(57) ABSTRACT

A harness system includes a shoulder portion including a first vented protective element and a raised harness device. A belt portion includes a second vented protective element and a raised belt device.

18 Claims, 16 Drawing Sheets

HARNESS WEBBING ELEVATION SYSTEM

CROSS-REFERENCES TO RELATED APPLICATIONS

This application claims priority from U.S. provisional patent application Ser. No. 61/389,212, filed Oct. 2, 2011, incorporated herein by reference.

BACKGROUND

1. Field

The embodiments relate to fall protection harnesses, and in particular to fall protection harnesses including ventilation and protection elements.

2. Description of the Related Art

Workers that work in elevated environments may employ fall protection gear, such as a fall protection harness. The current fall protection harnesses use straps that form a harness. With these typical harnesses, the straps are positioned directly on a user that is wearing the harness. The direct positioning of the harness straps causes perspiration, irritation, and may even cause injuries.

SUMMARY

One embodiment of the invention provides a harness system including a shoulder portion including a first vented protective element and a raised harness device. A belt portion includes a second vented protective element and a raised belt device.

Another embodiment of the invention provides a fall protection harness assembly. The fall protection harness assembly includes a web harness, a vented protective element, and a padding assembly. A curved harness securing device is coupled to the padding assembly and the web harness. A belt assembly is coupled to the web harness.

Still another embodiment of the invention provides a fall protection harness assembly including a web harness and a vented protective element. A padding assembly is coupled with the web harness and the vented protective element. A curved belt securing device is coupled to the padding assembly. A shoulder assembly is coupled to the web harness.

Other aspects and advantages of the present invention will become apparent from the following detailed description, which, when taken in conjunction with the drawings, illustrate by way of example the principles of the invention.

BRIEF DESCRIPTION OF THE DRAWINGS

The embodiments are illustrated by way of example, and not by way of limitation, in the Figures of the accompanying drawings and in which like reference numerals refer to similar elements and in which:

FIG. 7 illustrates a side view of the raised belt securing device shown in

FIG. 6 according to one embodiment of the invention;

DETAILED DESCRIPTION

The following description is made for the purpose of illustrating the general principles of the invention and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

The description may disclose several preferred embodiments of fall protection web harness systems and devices, as well as operation and/or component parts thereof. While the following description will be described in terms of fall protection web harness systems and devices for clarity and to place the invention in context, it should be kept in mind that the teachings herein may have broad application to all types of systems, devices and applications.

One embodiment of the invention provides a harness system including a shoulder portion including a first vented protective element and a raised harness device. A belt portion includes a second vented protective element and a raised belt device. The embodiments of the invention are very light weight and maintain the webbing of the harness system off a user's body to allow for air to circulate, which helps cool down a user during use. At the same time the embodiments of the invention create an easy-don body forming system that makes the web harness system embodiments easy to: organize (i.e., tangle resistant), inspect and don the web harness quickly, which reduces delays caused by taking the time to untangle a web harness. Additionally, the embodiments of the invention reduce irritation of users by having the web portion of a web harness positioned off the user's body.

Figure 1:
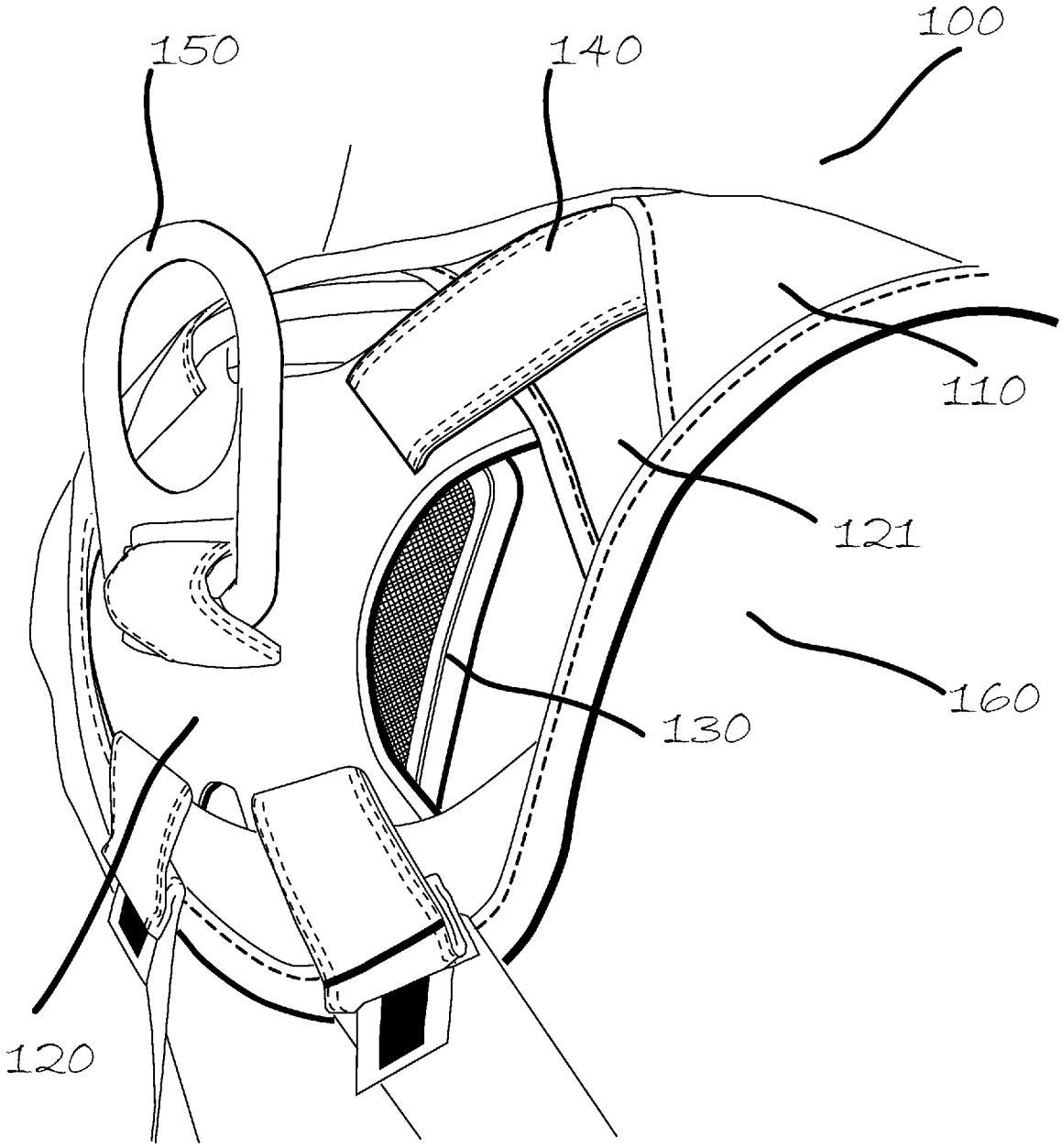
FIG. 1 illustrates a perspective view of a shoulder portion of a web harness system according to one embodiment of the invention.

FIG. 1 illustrates a perspective view of an upper/shoulder portion 100 of a web harness system shown worn on a modeled anatomy dummy 160 according to one embodiment of the invention. In one embodiment of the invention, the upper portion 100 includes a padding assembly 110, a raised/curved harness securing/coupling device 120, harness coupling device arm placement portions/pockets 121, an upper/back vented protective element 130, strap(s)/webbing 140 and an attachment ring 150. In one example, the upper portion 100 is employed as a safety harness where the padding assembly 110, the raised/curved harness coupling device 120 and the upper/back vented protective element 130 are ergonomically molded for comfort and perforated to provide ventilation for cooling.

As shown in FIG. 1, the webbing 140 passes through openings in the raised/curved harness coupling device 120 and is passed over and is covered by the padding assembly 110. In one embodiment of the invention, the webbing 140 is kept off of a user's body to provide comfort in combination with providing for escape of heat from a user via placement of perspiration zones of the user where the padding assembly 110 and the upper/back protective element 130 are positioned.

Figure 2:
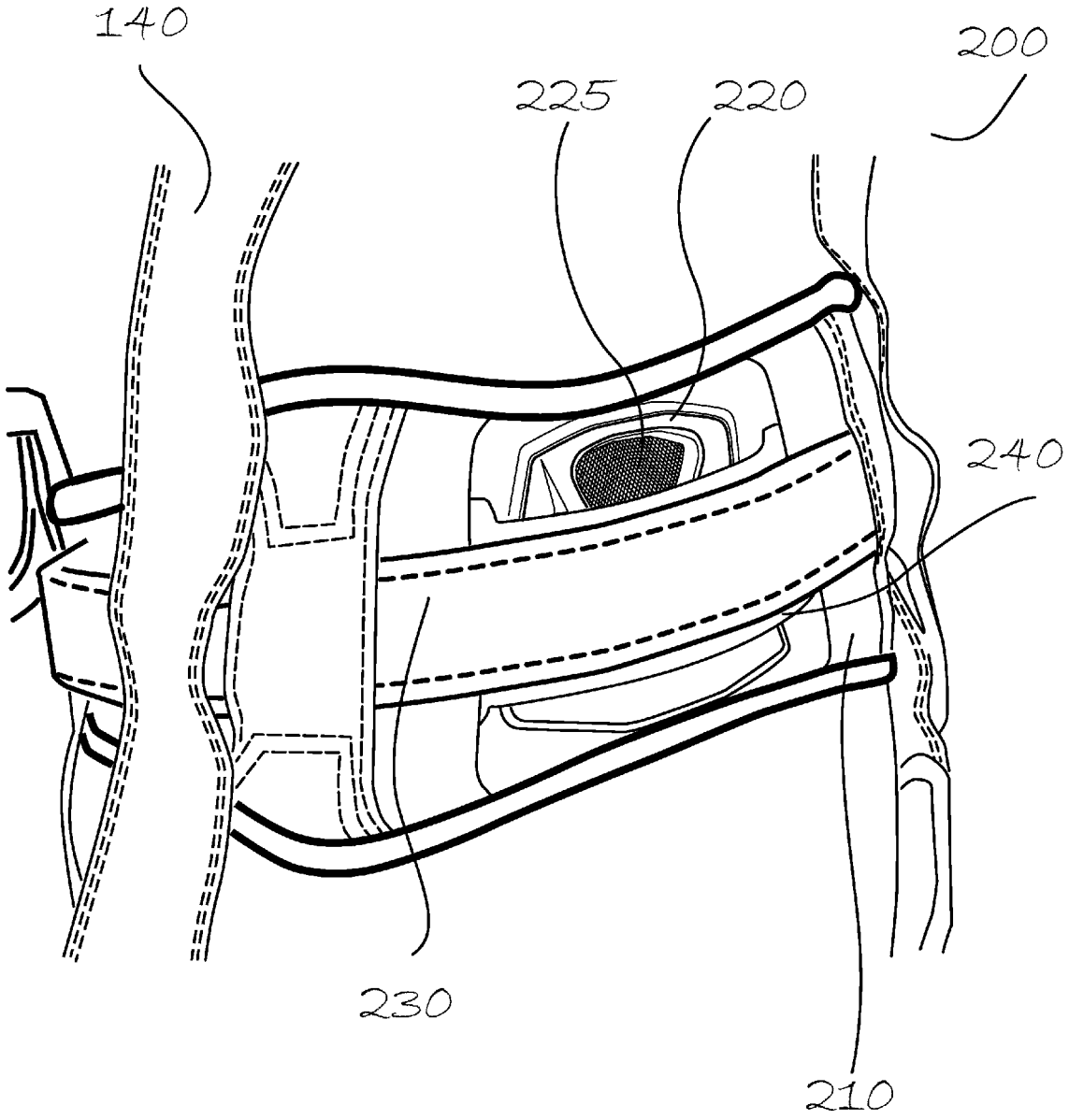
FIG. 2 illustrates a perspective view of a belt portion of a web harness system according to one embodiment of the invention.

FIG. 2 illustrates a perspective view of a belt portion 200 of a web harness system according to one embodiment of the invention. In one embodiment of the invention, the upper/shoulder portion 100 is coupled with the belt portion 200 via the webbing 140. As shown, the belt portion 200 includes a padding assembly 210, a vented protective element 220, a belt 230 and a raised/curved belt coupling device 240. In one embodiment of the invention, the vented protective element 220 includes vent openings 221 and 222 (FIG. 10) that are covered with vent covers 225 and 226, respectively. In one example, the vent covers 225 may be made of injection plastic with aluminum screen mesh. It should be noted that other similar materials may be used as well without diverting from the scope of the invention. In one example, the vent covers 225 function as a fabric abrasion protection component and also as a vent system allowing heat to rise away from the body of a user through the padding assembly 210. In one example, the webbing 240 is attached over and through openings in the padding assembly 240 in order to keep the webbing 140 off of the user's body.

Figure 3:
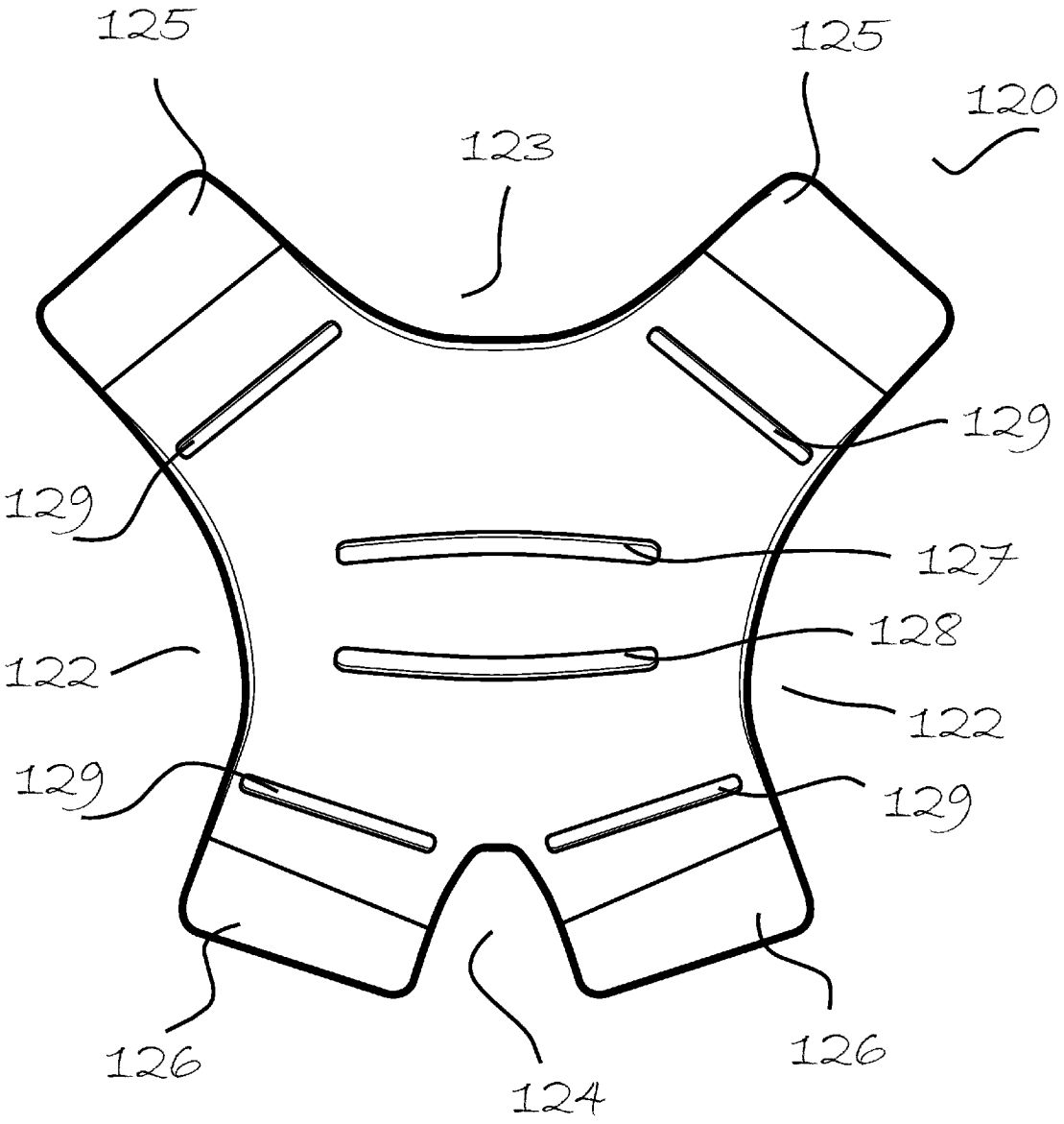
FIG. 3 illustrates a front view of a raised harness securing device according to one embodiment of the invention.

FIG. 3 illustrates a front isolated view of the raised/curved harness coupling device 120 according to one embodiment of the invention. In one embodiment of the invention, the raised/curved harness coupling device 120 includes arms 125 and 126, and webbing channels/openings 127, 128 and 129. In one example, the webbing 140 is passed through the webbing channels 126, 127, 128 and 129 and coupled with the ring attachment device 150 on the top of the raised/curved harness coupling device 120. In one embodiment of the invention, the arms 125 and 126 are coupled with the harness coupling device arm placement portions/pockets 121. The arms 125 and 136 spread the force of the webbing 140 in the direction of each arm 125 and 126 to relieve pressure from the center of the user's back when the ring attachment 150 is used for fall protection (i.e., the ring attachment is connected to a lifeline and the user is held via the lifeline to prevent falling).

In one example, the raised/curved harness coupling device 120 may be made of any flexible or non-flexible plastic composites, including but not limited to: ethylene-vinyl acetate (EVA), polyethylene (PE), polypropylene (PP), expanded polyethylene (EPE), nylon, polyoxymethylene (POM), etc. In other examples, other similar materials may be used, such as metals and metal alloys (e.g., steel, steel alloy, aluminum, etc.), or resin materials such as fiberglass, carbon fiber, epoxies, etc.

In one example, an opening 123 is formed between the arms 125 due to the arching/curving of the raised/curved harness coupling device 120. In another example, an opening 124 is formed between the arms 126 due to the arching/curving of the raised/curved harness coupling device 120. In still another example, openings 122 are formed between the arms 125 and 126 due to the arching/curving of the raised/curved harness coupling device 120. In one embodiment of the invention, the openings 122, 123 and 124 provide easy viewing for inspection of the webbing 140, which must occur before each use of the webbing harness system for safety precautions. As shown, the raised/curved harness coupling device 120 is wider towards the arms 125 than towards the arms 126 in order to ergonomically match the proportion of the anatomy of a user's back.

Figure 4:
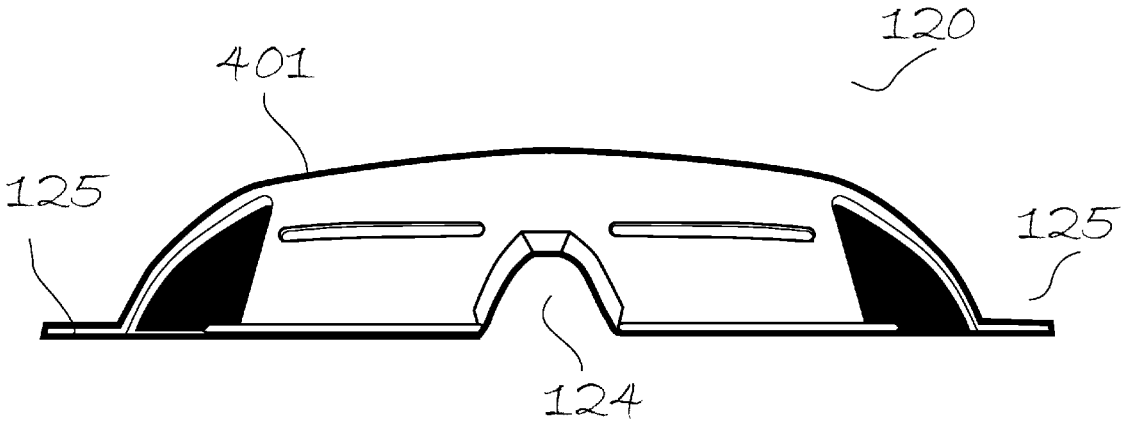
FIG. 4 illustrates a bottom view of the raised harness securing device shown in FIG. 3 according to one embodiment of the invention.

FIG. 4 illustrates a bottom view of the raised/curved harness coupling device 120 according to one embodiment of the invention. As shown, the top 401 of the raised/curved harness coupling device 120 is raised from the arms 125 for providing for placement of the upper/back protective element 130 under the raised/curved harness coupling device 120, which also provides a comfortable experience for a user by maintaining the webbing off of the user's body.

Figure 5:
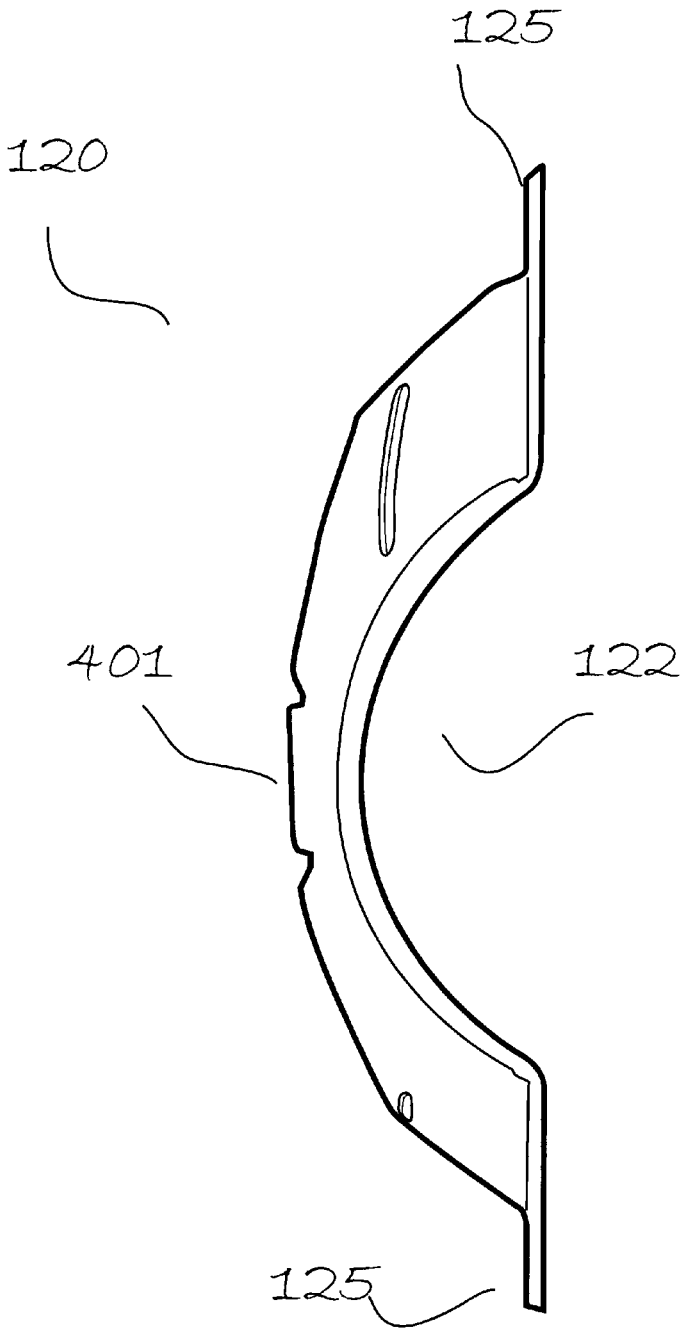
FIG. 5 illustrates a side view of the raised harness securing device shown in FIG. 3 according to one embodiment of the invention.

FIG. 5 illustrates a side view of the raised/curved harness coupling device 120. As shown, the opening 122 provides space between the padding assembly 110 for easy viewing and inspection of the webbing 140 on the underside of the raised/curved harness coupling device 120.

Figure 6:
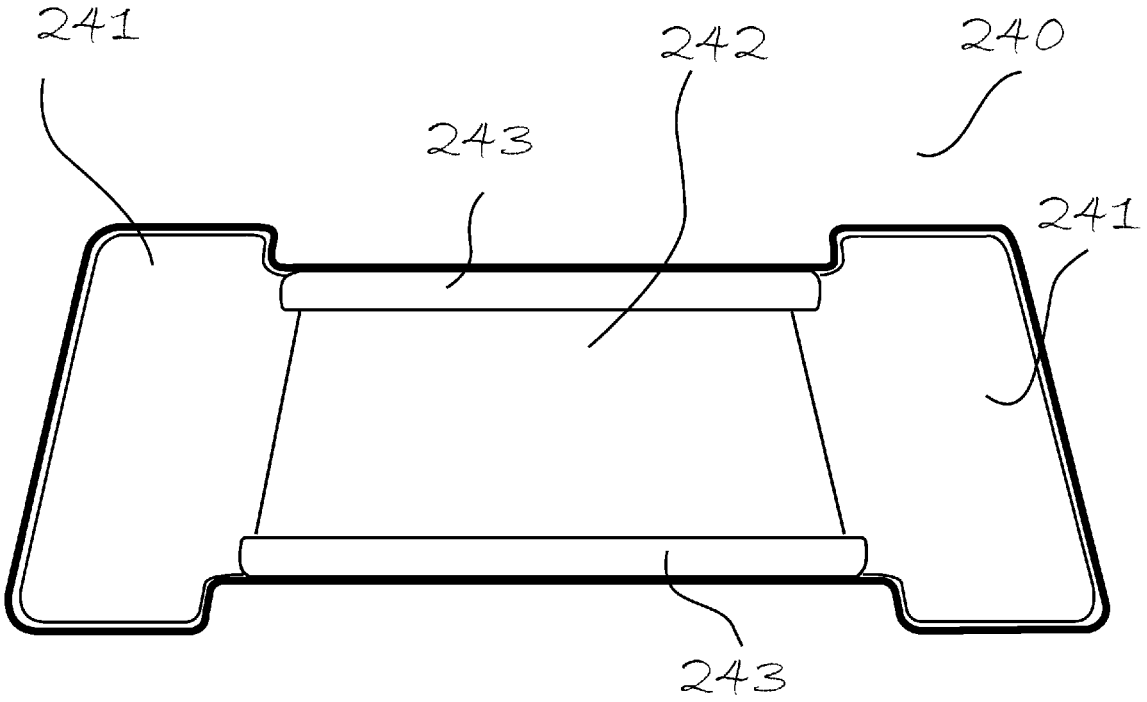
FIG. 6 illustrates a front view of a raised belt securing device according to one embodiment of the invention.

FIG. 6 illustrates a front isolated view of the raised/curved belt coupling device 240 according to one embodiment of the invention. As shown, the raised/curved belt coupling device 240 includes arms 241 that are placed in openings/pockets of the padding assembly 210 for securing the raised/curved belt coupling device 240 in place and also prevents flattening of the raised/curved belt coupling device 240 during applied force from the webbing 140 from, for example, during a fall incident. The raised/curved belt coupling device 240 includes raised portions 243 that forms a belt groove/channel 242 for maintaining placement of the belt 230.

In one example, the raised/curved belt coupling device 240 may be made of any flexible or non-flexible plastic composites, including but not limited to: EVA, PE, PP, EPE, nylon, POM, etc. In other examples, other similar materials may be used, such as metals and metal alloys (e.g., steel, steel alloy, aluminum, etc.), or resin materials such as fiberglass, carbon fiber, epoxies, etc.

Figure 7:
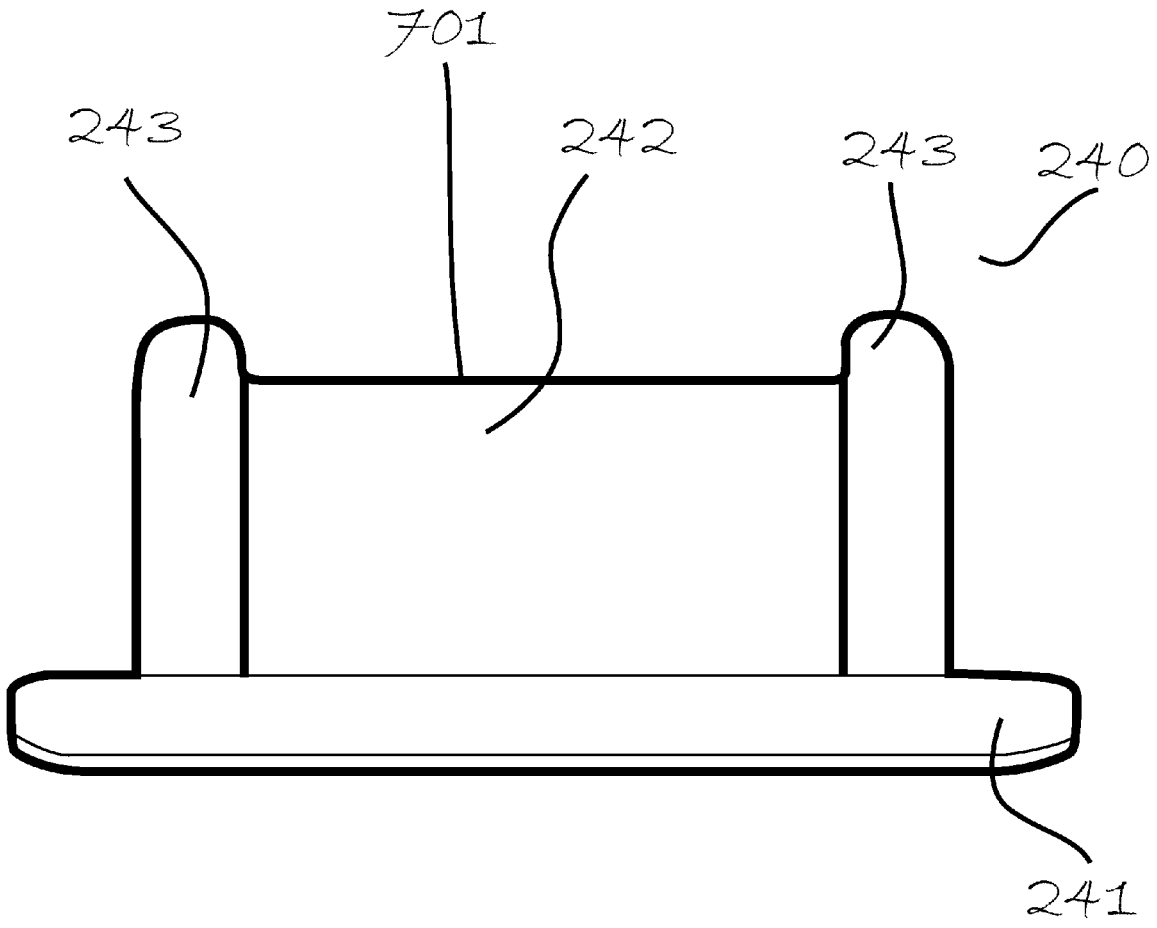

FIG. 7 illustrates a side isolated view of the raised/curved belt coupling device 240 according to one embodiment of the invention. As shown, the top 701 of the raised/curved belt coupling device 240 is arched/raised from the arms 241, which allows space over the vented protective element 220. The curved shape of the raised/curved belt coupling device 240 maintains ventilation by raising the belt away from the padding assembly 210 at a perspiration zone located on a user's back.

Figure 8:
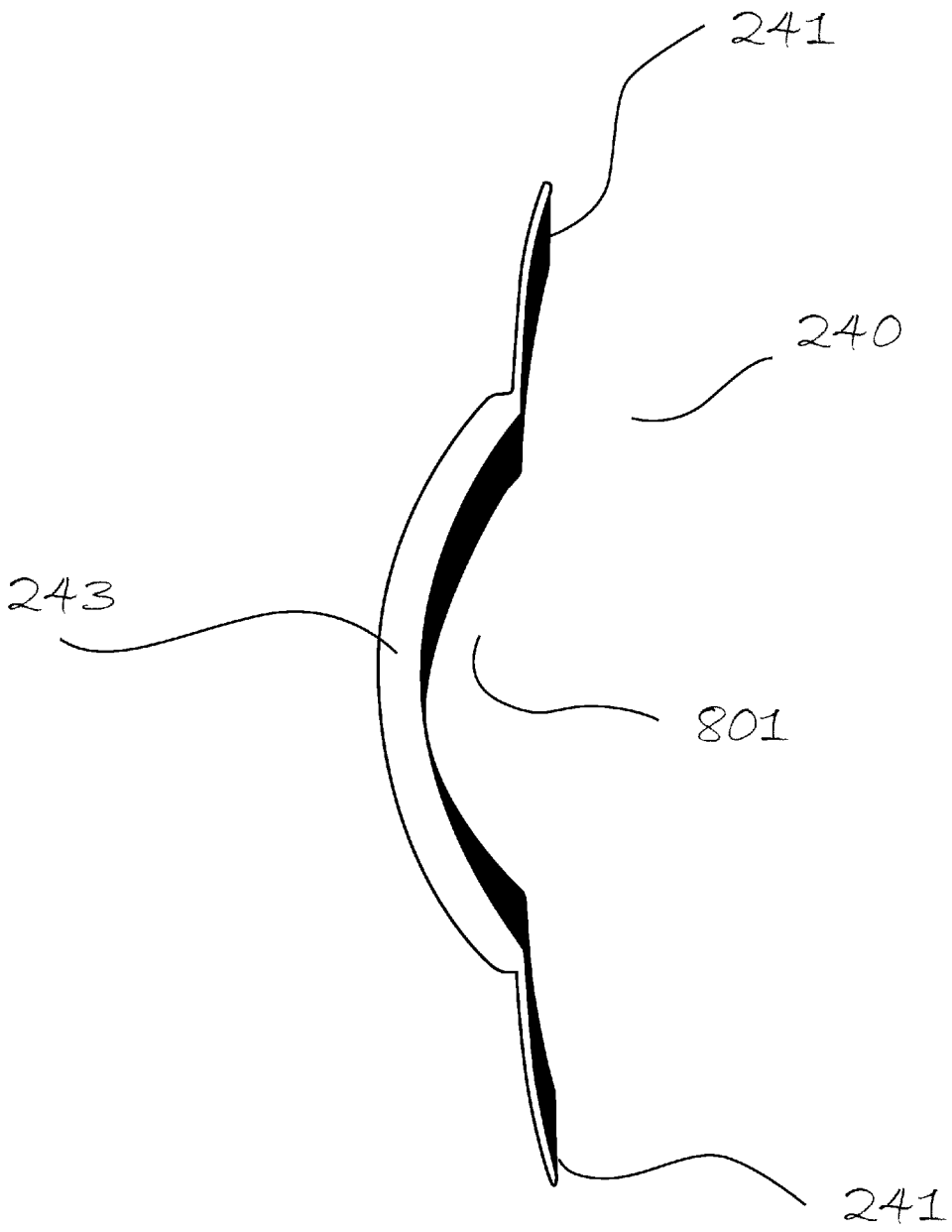
FIG. 8 illustrates a side view of view of the raised belt securing device shown in FIG. 6 according to one embodiment of the invention.

FIG. 8 illustrates a side view of the raised/curved belt coupling device 240 according to one embodiment of the invention. As shown, the arched/curved shape of the raised/curved belt coupling device 240 provides an opening 801 that provides ventilation to pass through from the vented protective element 220.

Figure 9:
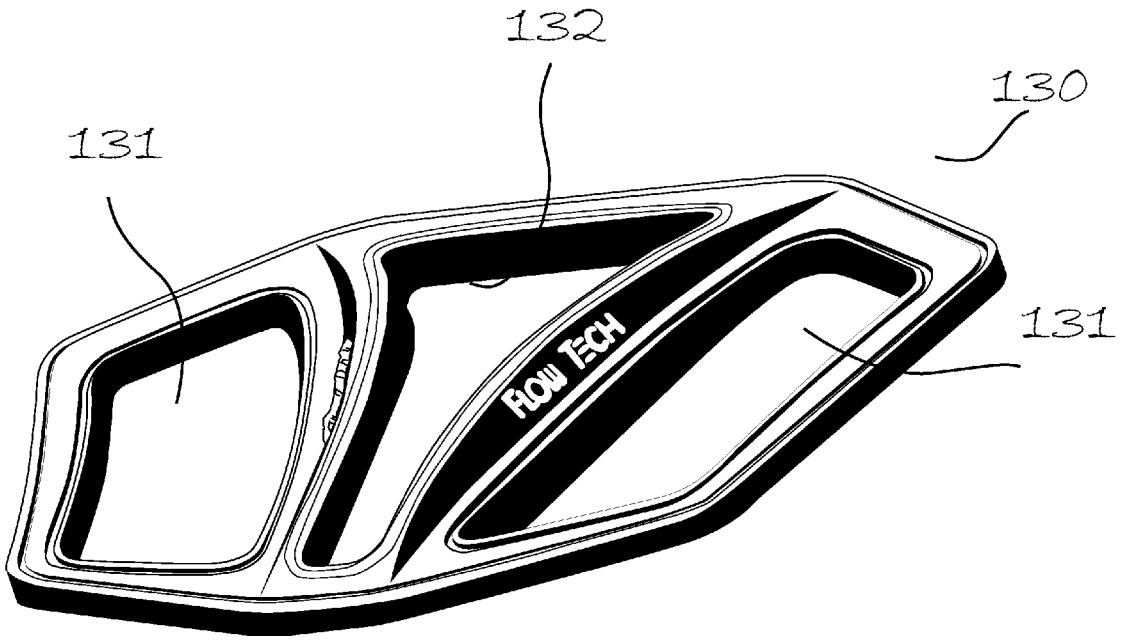
FIG. 9 illustrates a perspective view of a first vented protection device according to one embodiment of the invention.

FIG. 9 illustrates a perspective isolated view of the upper/back protective element 130 according to one embodiment of the invention. As shown, the upper/back protective element 130 includes openings 131 and 132. In one example, the openings 131 and 132 are covered with vent covers similarly as vent covers 225 and 226. In one example, the upper/back protective element 130 is curved to ergonomically be positioned on the padding assembly 110 over a perspiration zone of a user's back for providing ventilation through the padding assembly 110 and through the upper/back protective element 130 and out from the openings 122, 123 and 124 of the raised/curved harness coupling device 120. In one example, the upper/back protective element 130 provides for additional support and structure for the padding assembly 110 and protects against excess perspiration forming on a person since the openings 131 and 132 provide ventilation.

Figure 10:
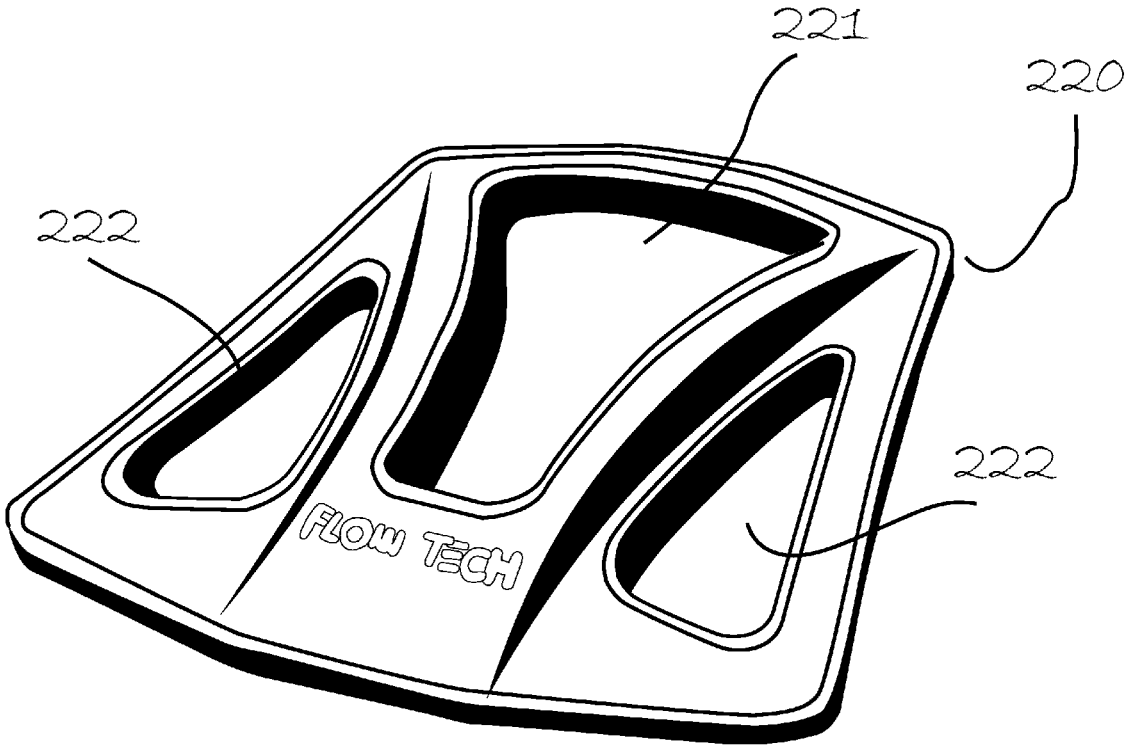
FIG. 10 illustrates a perspective view of a second vented protection device according to one embodiment of the invention.
Figure 11:
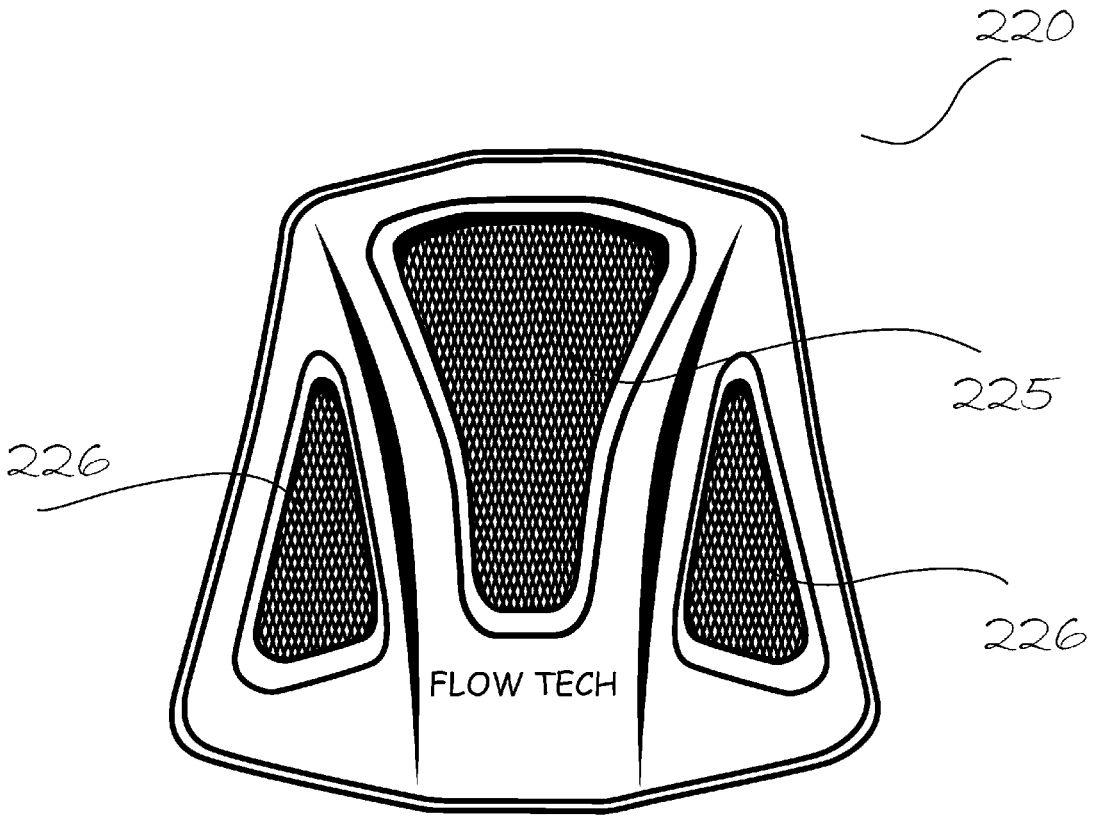
FIG. 11 illustrates the second vented protection device illustrated in FIG. 10 shown with a screen material covering vent openings according to one embodiment of the invention.

FIG. 10 illustrates a perspective isolated view of the vented protective element 220 according to one embodiment of the invention. As shown, the vented protective element 220 includes openings 221 and 222. In one example, the openings 221 and 222 are covered with vent covers 225 and 226 as illustrated in FIG. 11. In one example, the vented protective element 220 is curved to ergonomically be positioned on the padding assembly 210 over a perspiration zone of a user's lower back for providing ventilation through the padding assembly 210 and through the vented protective element 220 and out from the openings 801 of the raised/curved belt coupling device 240. In one example, the vented protective element 220 provides for additional support and structure for the padding assembly 210 and protects against excess perspiration forming on a person since the openings 221 and 222 provide ventilation.

Figure 12:
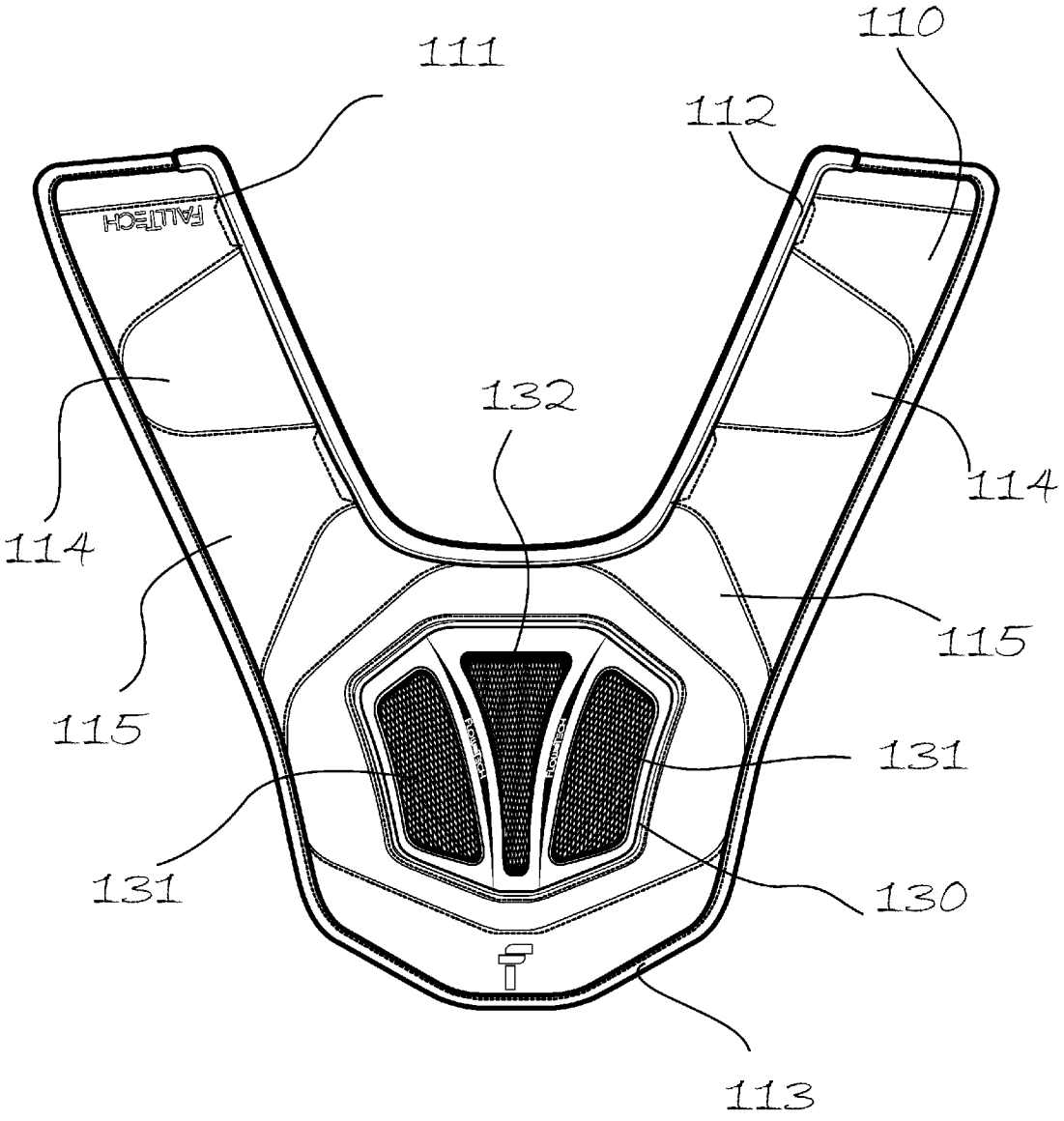
FIG. 12 illustrates a first padding assembly including the first vented protection device attached according to one embodiment of the invention.

FIG. 12 illustrates the padding assembly 110 including the upper/back protective element 130 attached according to one embodiment of the invention. In one embodiment of the invention, the upper/back protective element 130 is attached to the padding assembly 110 via heat welding, forming, stitching, press fitting, etc. As shown, the padding assembly 110 includes over shoulder arm portions 111 and 112, and over back portion 113. In one embodiment of the invention, the padding assembly 110 may be made of nylon, canvas, or other heavy duty and lightweight materials.

In one embodiment of the invention, the padding assembly 110 includes sleeves or through-openings 114 and 115 formed by overlapping material for placement of the webbing 140. In one example, the sleeves or through-openings 114 and 115 maintain the webbing on top of the padding assembly 110 and also holds the webbing in place for preventing tangling of the webbing 140.

Figure 13:
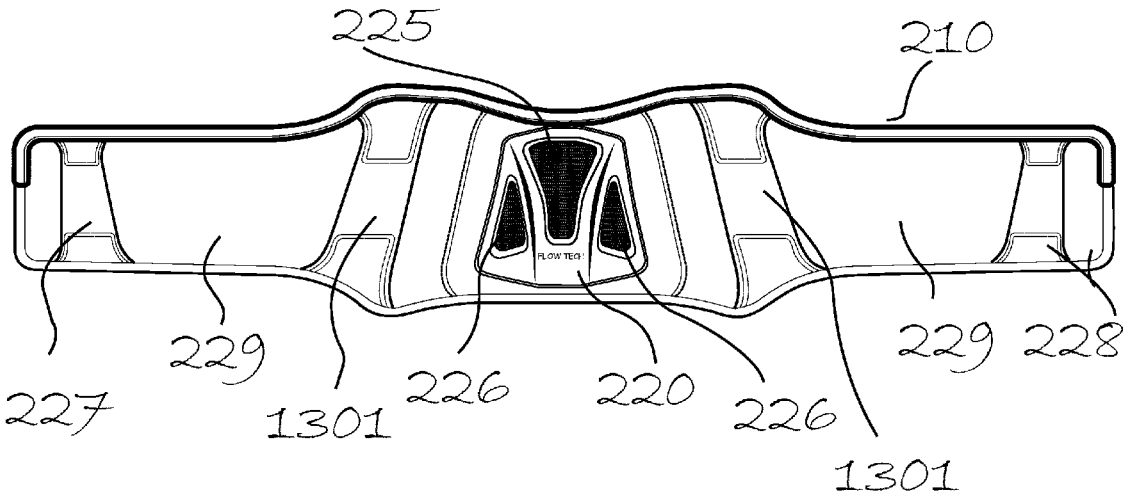
FIG. 13 illustrates a second padding assembly including the second vented protection device attached according to one embodiment of the invention.

FIG. 13 illustrates the padding assembly 210 including the vented protective element 220 attached according to one embodiment of the invention. In one embodiment of the invention, the vented protective element 220 is attached to the padding assembly 210 via heat welding, forming, stitching, press fitting, etc. As shown, the padding assembly 210 includes waist portions 229. In one embodiment of the invention, the padding assembly 210 may be made of nylon, canvas, or other heavy duty and lightweight materials.

In one embodiment of the invention, the padding assembly 210 includes sleeves or through-openings 227, 228 and 1301 formed by overlapping material for placement of the belt 230. In one example, the sleeves or through-openings 227, 228 and 1301 maintain the belt on top of the padding assembly 210 and also holds the webbing in place under the belt 230 for preventing tangling of the webbing 140.

In one embodiment of the invention, the padding assembly 110 and the padding assembly 210 may be made of ripstop nylon material and ballistic nylon material stitched together and perforated. It should be noted that other similar materials may be used as well without diverting from the scope of the invention.

Figure 14:
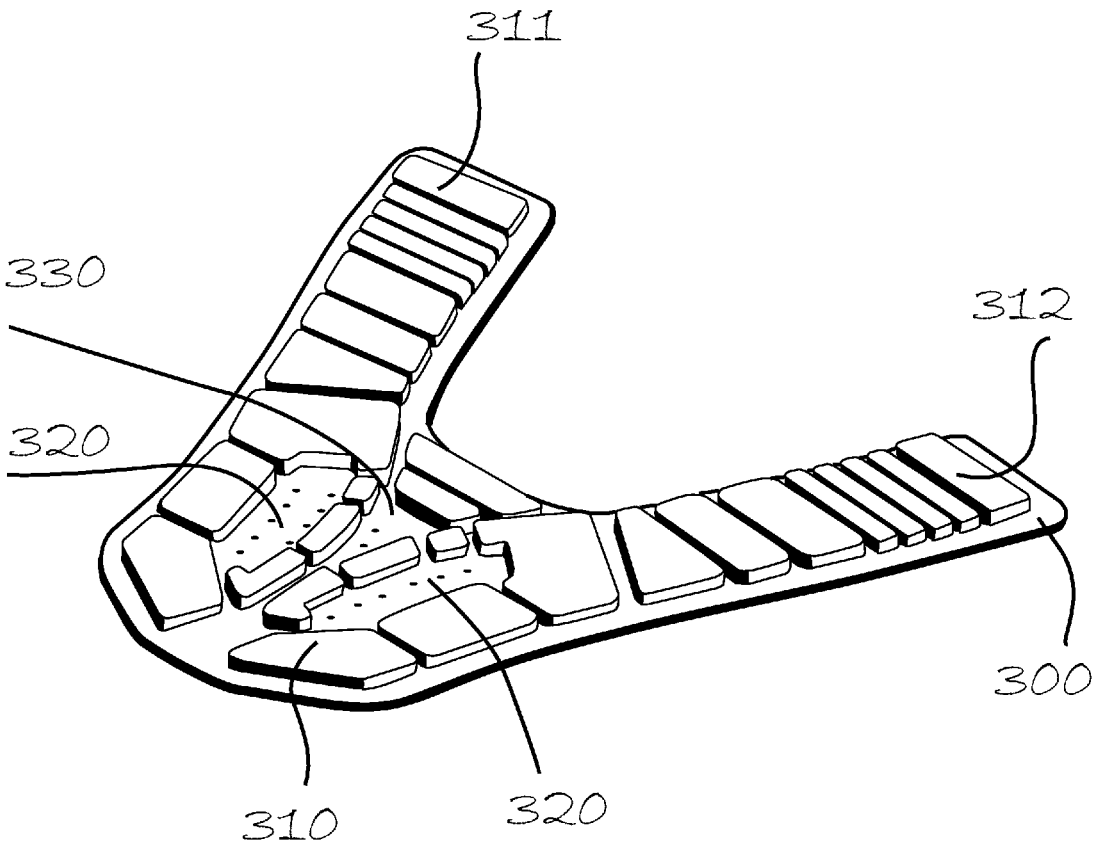
FIG. 14 illustrates a first padding lining for the first padding assembly shown in FIG. 12 according to one embodiment of the invention.

FIG. 14 illustrates a padding lining 300 for the padding assembly 110 shown in FIG. 12 according to one embodiment of the invention. In one embodiment of the invention, the padding lining 300 includes over the shoulder portions 311 and 312, padding segments 310, and vent zones 320 and 330. In one embodiment of the invention, the padding segments 310 may have varying shapes and sizes with a same height. In other embodiments of the invention, the height of the padding segments 310 may vary in order to ergonomically fit to a user's anatomy. In one example, vent channels are formed between adjacent padding segments 310 for providing channels for heat to escape.

In one example, the vent zones 320 correspond to the openings 131, and the vent zone 330 corresponds to the opening 132. As shown, the vent zones 320 and 330 include through-holes or channels for providing ventilation for heat to escape from a user through the padding assembly 110. In one example, the padding lining 300 may be made from light weight molded EVA. In other embodiments the padding lining may be made of other similar materials. The padding lining 300 provides added comfort as the padding lining provides cushioning that spreads the force caused from the webbing 140. In one example, the padding lining 300 is ergonomically formed for users and provides added airflow.

Figure 15:
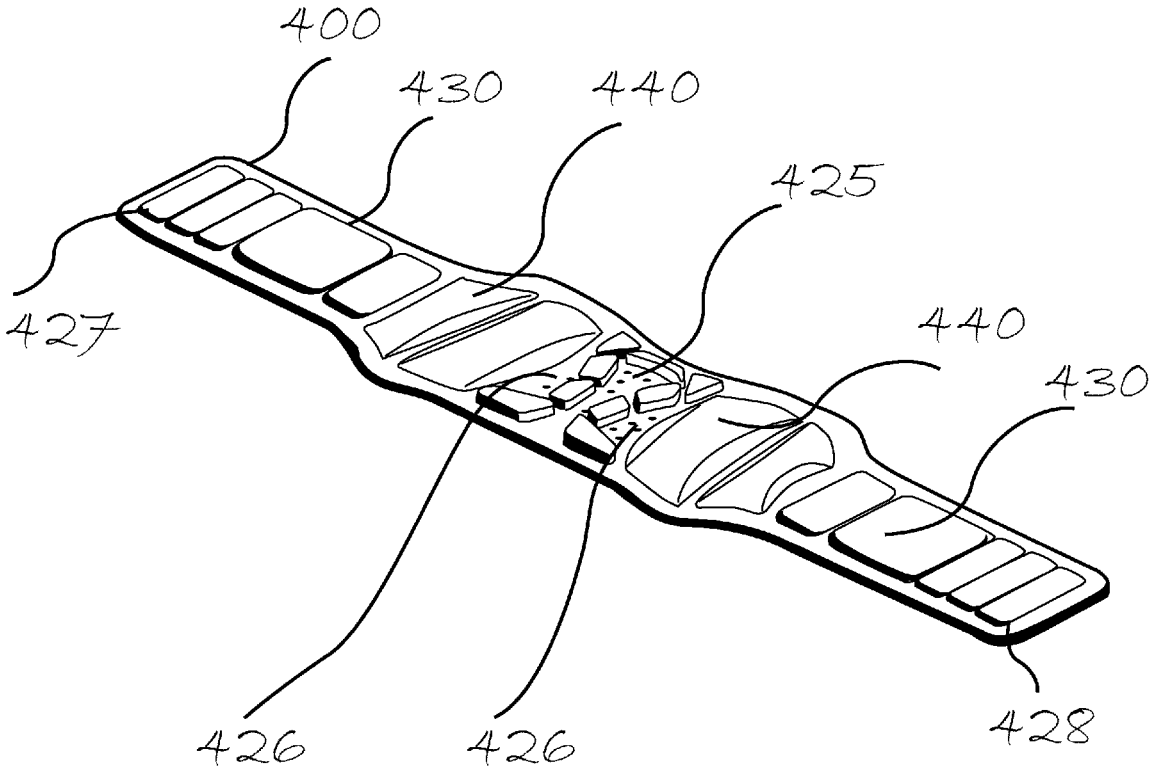
FIG. 15 illustrates a second padding lining for the second padding assembly shown in FIG. 13 according to one embodiment of the invention.

FIG. 15 illustrates a padding lining 400 for the padding assembly 210 shown in FIG. 13 according to one embodiment of the invention. In one embodiment of the invention, the padding lining 400 includes end portions 427 and 428, padding segments 430 and 440, and vent zones 425 and 426. In one embodiment of the invention, the padding segments 430 may have varying shapes and sizes with a same height. In other embodiments of the invention, the height of the padding segments 430 may vary in order to ergonomically fit to a user's anatomy. In one embodiment of the invention, the padding segments 440 provide added comfort and back support for users.

In one example, vent channels are formed between adjacent padding segments 430 and 440 for providing channels for heat to escape. In one example, the vent zones 426 correspond to the openings 222, and the vent zone 425 corresponds to the opening 221. As shown, the vent zones 425 and 426 include through-holes or channels for providing ventilation for heat to escape from a user through the padding assembly 210. In one example, the padding lining 400 may be made from light weight molded EVA. In other embodiments the padding lining may be made of other similar materials. The padding lining 400 provides added comfort as the padding lining provides cushioning that spreads the force caused from the belt 230 and the webbing 140. In one example, the padding lining 400 is ergonomically formed for users and provides added airflow.

Figure 16:
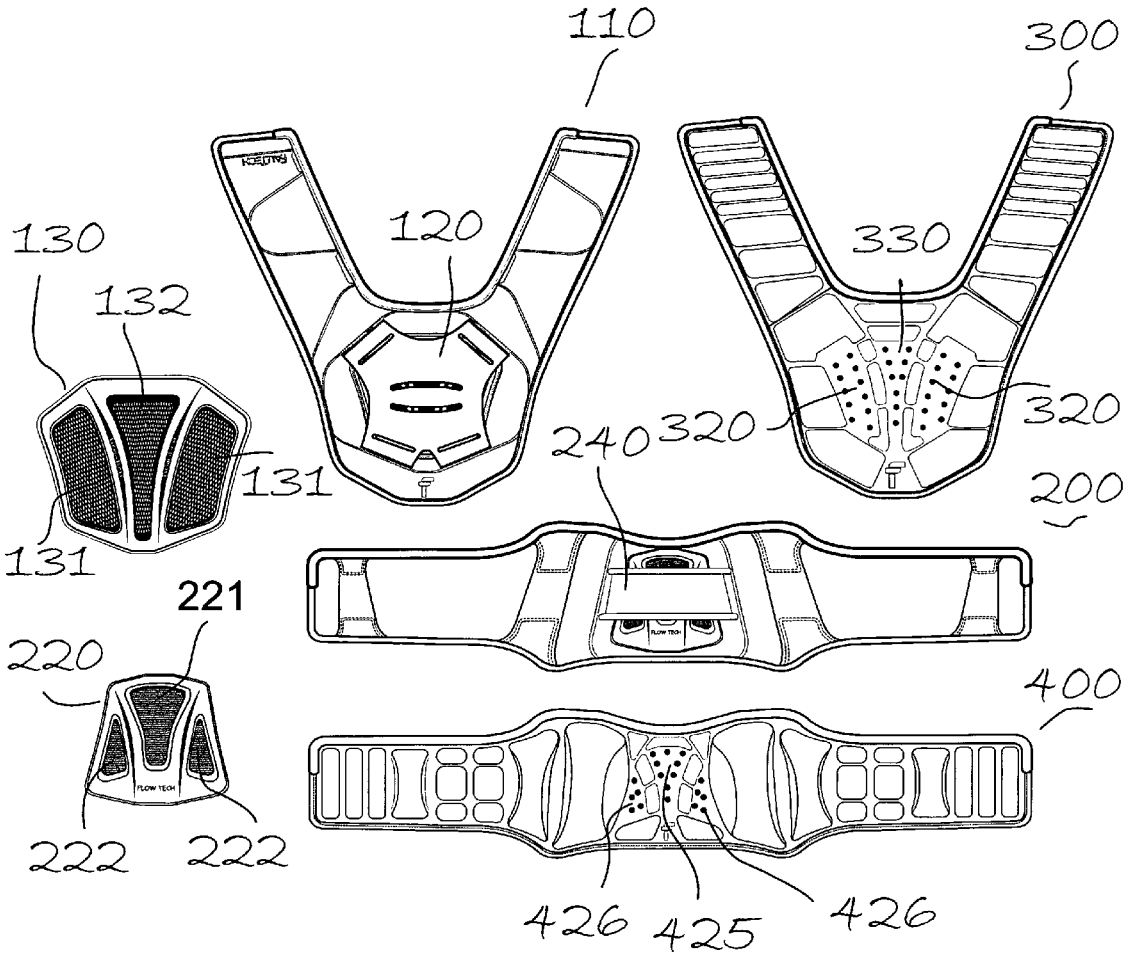
FIG. 16 illustrates the components of a web harness assembly shown with isolated components and without web harness straps according to one embodiment of the invention.

FIG. 16 illustrates the components of a web harness assembly system shown with isolated components and without webbing 140 according to one embodiment of the invention. As shown, the components include the padding assembly 110, padding lining 300, raised/curved harness coupling device 120, the upper/back protective element 130, padding assembly 200, padding lining 400, the raised/curved belt coupling device 240 and the vented protective element 220. The combination of the components of the web harness assembly system is light weight, comfortable and provides for air to circulate in and onto the body of a user while allowing heat to escape from key perspiration zones of the user's body.

In some embodiments of the invention, raised/curved components may be added to any area of the padding assemblies 110 and 210 where creating a structural device that lifts the webbing off or protects the body from direct webbing contact and provides ventilation under the webbing 140 locations.

In the description above, numerous specific details are set forth. However, it is understood that embodiments of the invention may be practiced without these specific details. For example, well-known equivalent components and elements may be substituted in place of those described herein, and similarly, well-known equivalent techniques may be substituted in place of the particular techniques disclosed. In other instances, well-known structures and techniques have not been shown in detail to avoid obscuring the understanding of this description.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A harness system comprising:

a shoulder portion including a first vented protective element, and a first webbing sleeve for holding a first webbing strap in place, and a second webbing sleeve for holding a second webbing strap in place;

a curved harness coupling device that includes a first pair of arms, a second pair of arms and a plurality of webbing channels, wherein each arm of the first pair of arms is positioned in a placement pocket on the shoulder portion; and a belt portion including waist portions and a second vented protective element and a curved belt coupling device, wherein the curved harness coupling device is positioned over and spaced apart from the first vented protective element.

2. The harness system of claim 1, wherein the curved harness coupling device is coupled to the shoulder portion over the first vented protective element, wherein a first opening space is formed between the first pair of arms based on arching of the curved harness coupling portion, and the curved harness coupling device comprises plastic composite material.

3. The harness system of claim 2, wherein the curved belt coupling device is coupled to the belt portion over the second vented protective element.

4. The harness system of claim 1, wherein:

the first vented protective element includes a first plurality of vent openings and the second vented element includes a second plurality of vent openings; and a first webbing sleeve of the pair of webbing sleeves is formed over a first placement pocket, and a second webbing sleeve of the pair of webbing sleeves is formed over a second placement pocket.

5. The harness system of claim 4, wherein the first plurality of vent openings and the second plurality of vent openings are each covered with a screen material.

6. The harness system of claim 5, wherein the shoulder portion comprises a first padding assembly coupled to a first padded lining including vent zones corresponding in position to the first plurality of vent openings.

7. The harness system of claim 6, wherein the first padded lining includes a first plurality of pad segments, and wherein a first plurality of vent channels are formed between adjacent pad segments of the first plurality of pad segments.

8. The harness system of claim 7, wherein the belt portion comprises a second padding assembly coupled to a second padded lining including vent zones corresponding to position of the second plurality of vent openings.

9. The harness system of claim 8, wherein the second padded lining includes a second plurality of pad segments, and wherein a second plurality of vent channels are formed between adjacent pad segments of the second plurality of pad segments.

10. The harness system of claim 1, wherein the curved harness coupling device prevents the first webbing strap and the second webbing strap from contacting a user back and shoulder area when wearing the harness system and provides ventilation.

11. A fall protection harness assembly comprising:

a web harness comprising a first webbing strap and a second webbing strap;

a first vented protective element;

a first padding assembly including a first webbing sleeve for holding the first webbing strap in place, and a second webbing sleeve for holding the second webbing strap in place;

a curved harness securing device coupled to the first padding assembly and the web harness, wherein the curved harness securing device comprising a first pair of arms, a second pair of arms and a plurality of webbing channels, wherein each arm of the first pair of arms is positioned in a placement pocket formed on the first padding assembly; and a belt portion comprising waist portions and a second padding assembly coupled with a second vented protective element and a curved belt coupling device, wherein the curved harness securing device and the belt portion are coupled to the web harness, wherein the curved harness securing device is positioned over and spaced apart from the first vented protective element.

12. The fall protection harness assembly of claim 11, wherein the curved harness securing device forms a space over the vented protective element.

13. The fall protection harness assembly of claim 11, wherein the first vented protective element includes a plurality of vent openings, wherein the plurality of vent openings are covered with a screen material.

14. The fall protection harness assembly of claim 13, wherein the first padding assembly is coupled to a padded lining including vent zones corresponding in position with the plurality of vent openings.

15. A fall protection harness assembly comprising:

a web harness;

a first vented protective element;

a shoulder assembly including a first padding assembly coupled with the first vented protective element;

a second vented protective element;

a belt portion comprising waist portions, a curved belt securing device and a second padding assembly coupled with the second vented protective element, wherein the curved belt securing device includes a first arm and a second arm, and the first arm is placed in a first pocket formed on the second padding assembly, and the second arm is placed in a second pocket formed on the second padding assembly, wherein the shoulder assembly and the belt portion are coupled to the web harness, wherein the curved belt securing device includes a belt groove, and the curved belt securing device is positioned over and spaced apart from the second vented protective element.

16. The fall protection harness assembly of claim 15, wherein the curved belt securing device forms a space over the vented protective element.

17. The fall protection harness assembly of claim 16, wherein the first vented protective element includes a plurality of vent openings, wherein the plurality of vent openings are coupled covered with a screen material.

18. The fall protection harness assembly of claim 17, wherein the first padding assembly is coupled to a padded lining including vent zones corresponding in position with the plurality of vent openings.

* * * * *